United States Patent [19]

Holtz et al.

[11] 4,207,944

[45] Jun. 17, 1980

[54] HEAT EXCHANGER FOR WITHSTANDING CYCLIC CHANGES IN TEMPERATURE

[75] Inventors: Maurice Holtz, Huntingdon Valley, Pa.; Krishna P. Singh; Alan I. Soler, both of Cherry Hill, N.J.

[73] Assignee: Joseph Oat Corporation, Camden, N.J.

[21] Appl. No.: 878,139

[22] Filed: Feb. 15, 1978

[51] Int. Cl.[2] ..... F28F 9/02

[52] U.S. Cl. ..... 165/82; 165/158

[58] Field of Search ..... 165/158, 173, 175, 81, 165/82, 83

[56] References Cited

U.S. PATENT DOCUMENTS

| | | | |
|---|---|---|---|
| 2,391,244 | 12/1945 | Jackson | 165/158 |
| 3,176,761 | 4/1965 | Anderson et al. | 165/175 |
| 3,490,521 | 1/1970 | Byerley | 165/158 |
| 3,768,554 | 10/1973 | Stahl | 165/158 |
| 3,814,178 | 6/1974 | Parussel | 165/158 |

FOREIGN PATENT DOCUMENTS

| | | | |
|---|---|---|---|
| 855717 | 11/1952 | Fed. Rep. of Germany | 165/173 |
| 2005750 | 8/1971 | Fed. Rep. of Germany | 165/158 |
| 1122105 | 9/1956 | France | 165/176 |
| 1123309 | 9/1956 | France | 165/173 |

*Primary Examiner*—Sheldon Richter

*Attorney, Agent, or Firm*—Seidel, Gonda, Goldhammer & Panitoh

[57] ABSTRACT

A shell and tube type heater exchanger is disclosed for withstanding cyclic changes in temperatures of fluid without suffering failure by removing metal from the outer periphery of a tube sheet. The central portion of the tube sheet is a smooth arching contour mating with portions of the adjoining shell proximate to the tube sheet periphery without abrupt changes of section so that the surfaces blend with one another.

7 Claims, 4 Drawing Figures

HEAT EXCHANGER FOR WITHSTANDING CYCLIC CHANGES IN TEMPERATURE

BACKGROUND

In the conventional shell and tube type heater exchanger for transferring heat from one fluid to another, there is generally provided a cylindrical shell enclosing a plurality of parallel tubes supported at their ends by tube sheets. The tube sheet is usually a perforated circular metallic plate to which the ends of the tubes are metallurgically bonded as by welding.

Since one fluid is usually at a higher temperature than the other fluid at almost all locations of the walls that separate them, mechanical stresses are caused by thermal expansion when the temperature of one or both fluids change as may be occasioned by the actual temperature of the fluid or the rate of flow. The stresses created are high in situations where the metallic portions of the heat exchanger are restrained from expanding freely. Thermal stresses are generally comparatively high in thick metals that undergo sudden change in temperature of one face because the effect of expansive force is immediate whereas considerable time is required for conduction of heat through thick portions, and thick portions are self-retraining by reason of their thickness. Thus, it is possible for the tube sheet due to its lower mass to change its temperature in 10 seconds whereas adjacent portions of the shell might not reach the new temperature for 5 to 10 minutes.

Tube sheets are usually quite thick by comparison with the tubes or with the shell. Internal thermal stresses are often quite high in tube sheets. Severe changes in flow conditions or temperature may cause stresses to be severe in the tube sheet. When a heat exchanger goes through many cycles of temperature change, the reversal of thermal stresses may eventually cause the metal to crack and leak at the boundry between the shell and the tube sheet.

SUMMARY OF THE INVENTION

The present invention is directed to an improved design of the shell and tube sheet of a heater exchanger so that it is capable of withstanding cyclic changes in temperature of the fluids without suffering plastic failure and fatigue damage. This is accomplished by a structural interrelationship featuring a smooth arching contour for merging a curved major face of a tube sheet into the inner peripheral surface of the shell adjacent to the outer periphery of the tube sheet without abrupt changes of section so that the surfaces blend with one another.

It is an object of the present invention to provide a heat exchanger structurally interrelated in a manner so as to be capable of withstanding cyclic changes in temperature without damage while also being capable of withstanding high internal pressures.

Other objects will appear hereinafter.

For the purpose of illustrating the invention, there is shown in the drawings a form which is presently preferred; it being understood, however that this invention is not limited to the precise arrangements and instrumentalities shown.

Figure 1:
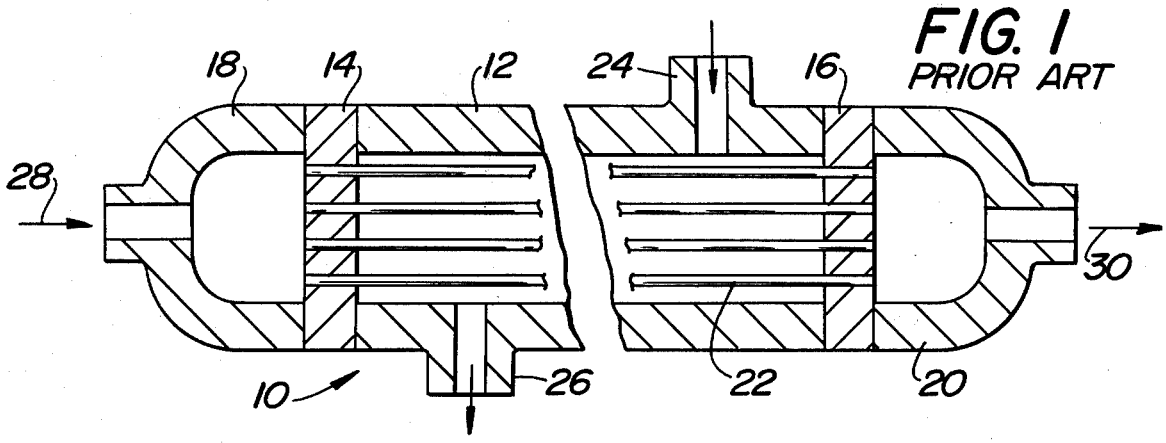
FIG. 1 PRIOR ART
FIG. 1 is a sectional view of a prior art heat exchanger.

Referring to the drawing in detail, wherein like numerals indicate like elements, there is shown in FIG. 1 a typical prior art heat exchanger designated generally as 10. The heat exchanger 10 includes a cylindrical shell 12 joined to transversely disposed tube sheets 14 and 16. A channel 18 is metallurgically bonded to the periphery of tube sheet 14. A channel 20 is metallurgically bonded to the periphery of sheet 16.

The tube sheets 14 and 16 are perforated. A tube 22 extends through each perforation in the tube sheets. The ends of the tubes 22 facing the channels 18 and 20 are welded to their respective tube sheets. One fluid enters channel 18 in the direction of arrow 28, flows through the tubes 22, and exits from channel 20 in the direction of arrow 30. The shell 12 is provided with an inlet 24 and an outlet 26 so that a second fluid may flow through the shell in heat exchange relationship with the tubes 22.

When the fluid entering channel 18 in the direction of arrow 28 suddenly rises in temperature, the tube sheet 14 and the adjoining walls of shell 12 and channel 18 react in a complex manner. First, the temperature of the perforated portion of the tube sheet 14 rises quickly following the temperature rise because of the intimate contact with the higher temperature fluid. The metal of the adjoining channel 18 also rises but less quickly because of less surface contact with the hotter fluid and the fluid barrier film on the inner surface of channel 18. The metal of shell 12 increases at an even slower rate as compared with channel 18. Because of the changes in the differential temperatures occurring as described, very high stresses are induced at the discontinuity regions wherein the tube sheet 14 is metallurgically bonded to the shell 12 and channel 18. If such temperature changes are repeated, the metal may undergo fatigue damage and eventually crack. Similar damage may occur when the temperature of the incoming fluid is suddenly lowered due to the fact that the same kind of stresses in an opposite sense are generated. The problem is further compounded by pressure differentials between the two fluids. Hence, the problem solved is a redesign of the structural interrelationship of the components which will relieve the inducement of stresses resulting from cyclic temperature changes while at the same time minimizing a weakening of the heat exchanger so that it may still perform at the postulated design pressure differentials. The fluids may be at pressures as high as 4000 psi.

Figure 2:
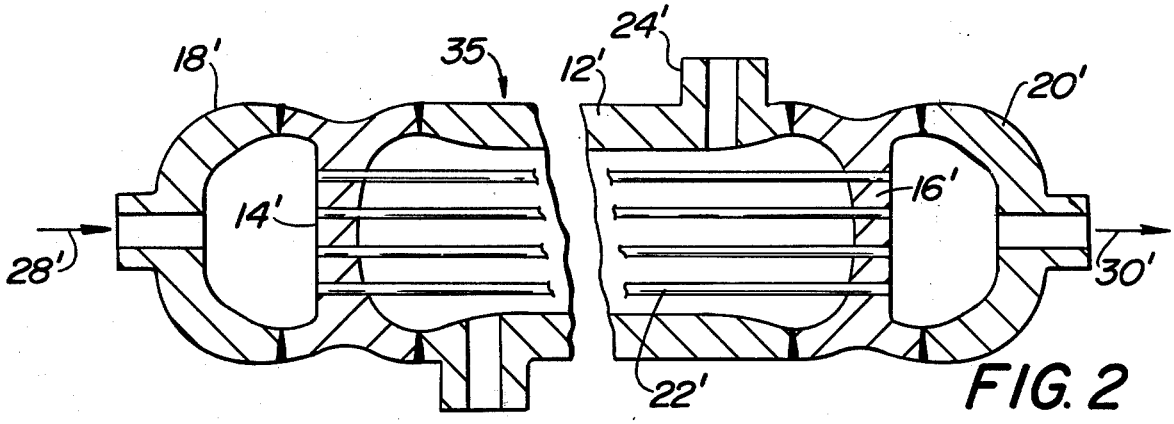
FIG. 2 is a sectional view of a heater exchanger in accordance with the present invention.
Figure 3:
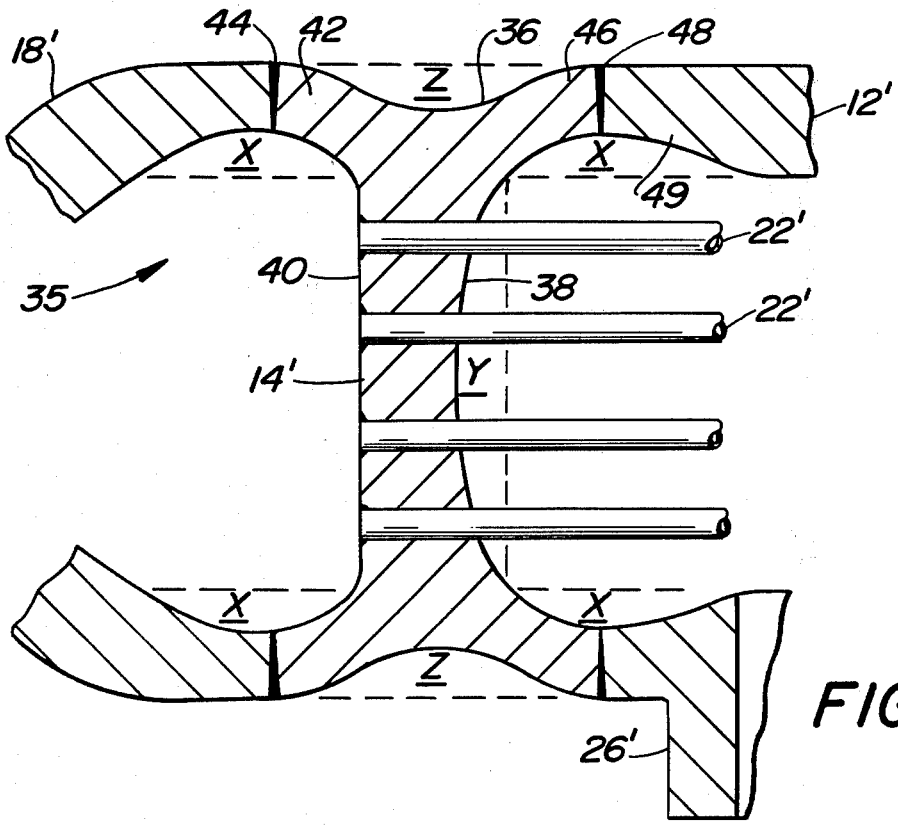
FIG. 3 is an enlarged detail view of one end portion of the heat exchanger shown in FIG. 2.

The heat exchanger of the present invention is designated generally as 35 and is shown in FIGS. 2 and 3. Heat exchanger 35 is generally similar to heat exchanger 10. Accordingly, corresponding elements have corresponding primed numerals except as will be made clear hereinafter. The structural interrelationship of the tube sheet and its surrounding elements is the same at each end of the heat exchanger 35. Accordingly, only the lefthand end of the heat exchanger as seen in FIG. 2 will be described in detail.

Referring to FIG. 3, it will be noted that the tube sheet 14' is generally I-shaped in cross-section with the tube sheet proper being provided with a concave peripheral surface 36. The surface 36 was attained by removing the material from area Z. The metal removed from area Z exerted radial expansive forces at high temperature differentials. Further, one major face of tube sheet 14' is provided with a concave surface 38 by removing metal from the area Y. While material may be removed from face 40 of the tube sheet 14', with face 40 planar, the fabrication step of welding tube sheet 14' to the ends of the tubes 22' is simplified.

The annular flange 42 on the tube sheet 14' as well as the adjacent portion of the channel 18' have metal removed from the area designated X so as to decrease the thickness of these portions as shown in FIG. 3 so that the inner periphery of the thinned portions merges with adjacent portions in a smooth manner without abrupt changes of thickness. Flange 40 is metallurgically bonded to the channel 18' by weld 44 in the thinned portions thereof.

The flange 46 of the tube sheet 14 is similarly thinned by the removal of metal from the area X so that it smoothly merges into a reduced thickness portion or transition piece 49 on the shell 12' and smoothly merges with the surface 38. Flange 46 is metallurgically bonded to the reduced thickness portion of the shell 12' by weld 48. It will be noted that only common fabricating techniques involving cutting, grinding and/or welding is utilized to attain the structural interrelationship shown in FIGS. 2 and 3. The metal removed from the areas X, Y and Z relieves the stressing condition so that the heat exchanger 35 may be capable of withstanding cyclic changes in temperature without suffering failure or damage, while at the same time minimizes any weakening of the structure so that it may withstand the desired pressures.

Figure 4:
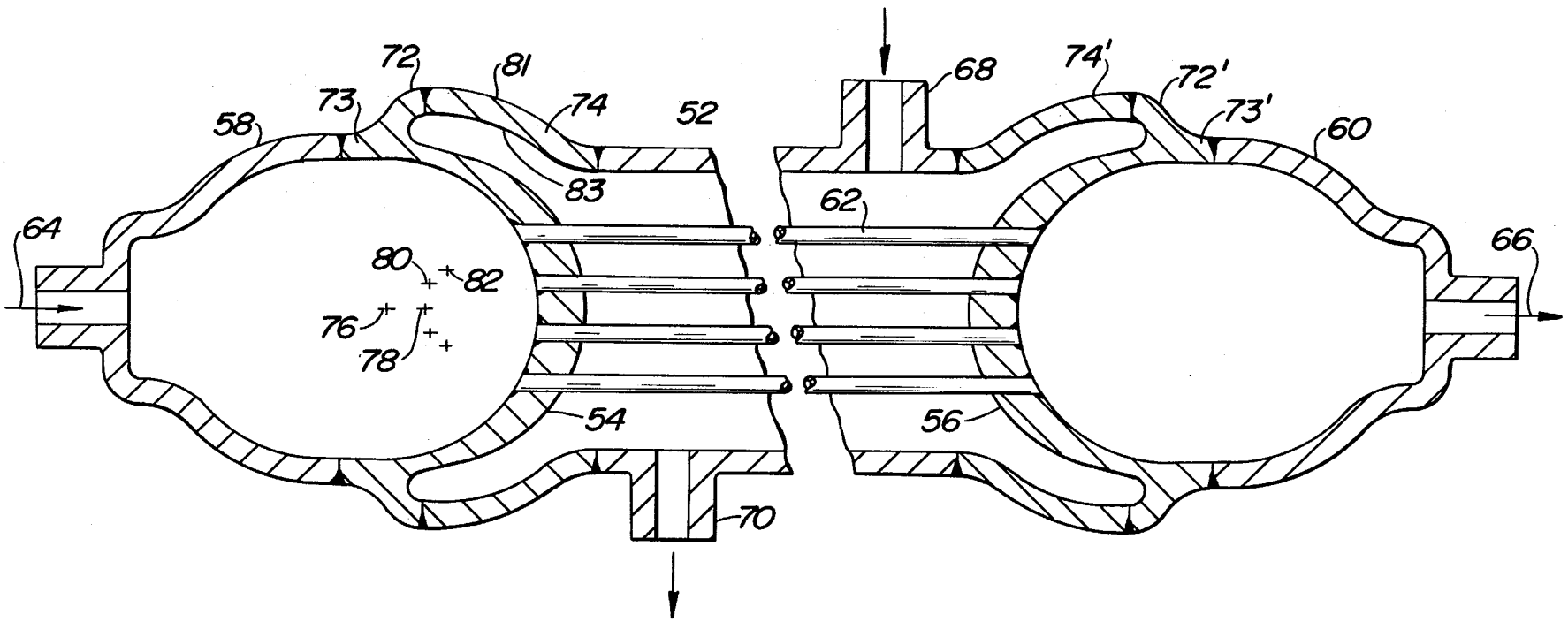
FIG. 4 is a sectional view of the preferred embodiment of the present invention.

In FIG. 4, there is illustrated in section a heat exchanger 50 constituting the preferred embodiment of the present invention. The heat exchanger 50 includes a generally cylindrical shell 12 joined to transversely disposed tube sheets 54, 56. A channel 58 is metallurgically bonded to the periphery of tube sheet 54. A channel 20 is metallurgically bonded to the periphery of tube sheet 56.

The tube sheets 54 and 56 are perforated. A tube 62 extends through each perforation in the tube sheets 54, 56. The ends of the tubes 62 facing the channels 58 and 60 are welded to their respective tube sheets. One fluid enters channel 58 in a direction of arrow 64, flows through the tubes 62, and exits from channel 60 in the direction of arrow 66. The shell 52 is provided with an inlet 68 and an outlet 70 so that a second fluid may flow through the shell in heat exchange relationship with the tubes 62.

It will be noted that tube sheets 14', 16', 54 and 56 each have a concave surface on at least one major face and also have a convex surface on the shell side which provides a smooth transition at the area where the shell and the tube sheet are connected. In heat exchanger 50, tube sheets 54, 56 have a concave surface on the major face thereof juxtaposed to the channel and a convex major face on the shell side. It will be noted that the tube sheets 54, 56 are not of uniform thickness, but rather are thicker in their central or middle region.

Tube sheet 54 has peripheral flanges 72, 73. Tube sheet 56 has a peripheral flange 72', 73'. One end of shell 52 is connected to flange 72 by way of a transition piece 74. The other end of shell 52 is connected to flange 72' by way of a transition piece 74'. The tube sheets 54, 56 are generally semi-spherical with their respective peripheral flanges 73, 73' being welded or otherwise connected to their respective channels.

The inner surface of the transition pieces 74, 74' provide a smooth arcing contour for merging the inner periphery of the shell 52 with a curved face on the tube sheet without abrupt changes in thickness so that the surfaces blend one with the another. The transition pieces 74, 74' are preferably made from materials which increase the capability of their particular shape to withstand thermal transients and are of substantially uniform wall thickness. In this regard, the transition pieces 74, 74' may be made from bimetallic materials such as a stainless steel facing on a carbon steel base. Carbon steel is more conductive than stainless steel. The transition pieces are preferably of a material which is a better heat conductor than the material of the tube sheets. If desired, portions of the inner surface of the transition pieces 74, 74' may be provided with fins. When constructed in this manner, the transition pieces prevent the development of steep thermal gradients at the juncture between the tube sheets 54, 56 and the shell 52.

The numeral 76 is directed to the point constituting the center of curvature for the concave face of tube sheet 54; the point 78 constitutes the center of curvature of the convex face of tube sheet 54; the point 80 constitutes the center of curvature of surface 81 on transition piece 74; and point 82 constitutes the center of curvature of surface 83 on transition piece 74. The untubed portion of surface 54 cooperates with the juxtaposed portion of surface 83 to define a toroidal region of low turbulence.

In each of the heat exchangers 35 and 50, there is provided a means for enabling the tube sheet and an adjacent portion of the shell to withstand cyclic changes in fluid temperatures as a result of a curved surface on at least one major face of the tube sheet and curved surfaces providing a smooth transition at the area where the shell is connected to the periphery of the tube sheet. In each of heat exchangers 35 and 50, the tube sheets have a peripheral flange welded to one end of the shell and another peripheral flange welded to one end of the channel. It is preferred to have the concave surface of the tube sheets facing the higher design pressure.

The present invention may be embodied in other specific forms without departing from the spirit or essential attributes thereof and, accordingly, reference should be made to the appended claims, rather than to the foregoing specification as indicating the scope of the invention.

We claim:

1. A heat exchanger comprising a shell having an inlet and an outlet, first and second tube sheets, each tube sheet having a pair of flanges at its periphery, each tube sheet having one flange connected to an end of the shell by a weld, each tube sheet having its other flange connected to a channel by a weld, a plurality of parallel tubes supported by said tube sheets and disposed within said shell for heat exchange relationship with respect to fluid in said shell, each end of each tube being in communication with one of said channels, means including said flanges on said tube sheets for enabling the tube sheets and the adjacent portion of the shell and channel to withstand cyclic changes in fluid temperatures, said means including a curved major face on said tube sheets and curved surfaces on transition pieces providing a smooth transition with said major faces at the area where said shell is connected to the periphery of said tube sheets, said major faces of said tube sheets facing the shell interior and being generally semi-spherical convex surfaces, untubed peripheral portions of said convex surfaces cooperating with the juxtaposed curved surfaces on the inner periphery of said transition pieces to define toroidal regions of low turbulence, and the central region of said tube sheets being thicker than said peripheral portions.

2. In a heat exchanger comprising a shell welded at one end to a discrete transition piece which in turn is welded to a flange on the outer periphery of a tube sheet, said shell and transition piece being coaxial with said tube sheet, said shell being on one side of said tube sheet, a channel on the other side of said tube sheet and welded to said tube sheet, the inner periphery of said shell merging smoothly with the inner periphery of said transition piece, the inner periphery of said transition piece merging smoothly with a curved surface on said flange, said curved surface on said flange merging smoothly with a convex surface on a major face of said tube sheet which is exposed to the interior of said shell, the central portion of the tube sheet being thicker than a peripheral portion, and the surface of said tube sheet remote from the interior of said shell being concave with a different radius of curvature as compared with said convex surface.

3. A heat exchanger comprising a shell having an inlet and outlet, at least one tube sheet having a pair of flanges at its periphery, one of said tube sheet flanges being connected to an end of the shell by a weld, the other flange being connected to a channel by a weld, a plurality of parallel tubes supported at one end by said tube sheet and disposed within said shell for heat exchange relationship with respect to a fluid in said shell, said one end of said tubes being in communication with said channel, means including said flanges on said tube sheet for enabling the tube sheet and the adjacent portion of the shell and channel to withstand cyclic changes in fluid temperature and to prevent development of steep thermal gradients at a juncture between the tube sheet and shell, said means including a convex major face of said tube sheet and curved surfaces which provide a smooth transition from said major face at the area where said shell is connected to said one flange of the tube sheet, said major face of said tube sheet facing the shell interior and being generally semi-spherical, said tube sheet being concave on the opposite major face, the center of a curvature of said convex major face being spaced from the center of curvature of said concave major face.

4. A heat exchanger in accordance with claim 3 wherein said tube sheet is thicker in a central portion as compared with a portion thereof between said central portion and the flanges on the periphery of the tube sheet.

5. A heat exchanger in accordance with claim 3 wherein said means includes a transition piece made from a material which is a better heat conductor than the material of the tube sheet, said transition piece being welded to said shell and one flange of the tube sheet.

6. A heat exchanger in accordance with claim 3 wherein said shell is connected to the tube sheet by a transition piece whose inner and outer surfaces are curved, the centers of curvature of said curved surfaces on said transition piece being closer to said concave surface of the tube sheet as compared with the center of curvture of the convex surface on the tube sheet.

7. A heat exchanger in accordance with claim 6 wherein untubed portions of said convex surface cooperate with the inner curved surface on the transition piece to define a toroidal region of low turbulence.

* * * * *